United States Patent [19]

Morinaka et al.

[11] Patent Number: 4,585,722

[45] Date of Patent: Apr. 29, 1986

[54] OPTICAL RECORDING MEDIA WITH THERMAL COLORATION AND PROCESS FOR PRODUCING SAME

[75] Inventors: Akira Morinaka, Mito; Shigeru Oikawa, Katsuta; Hirotsugu Sato, Mito, all of Japan

[73] Assignee: Nippon Telegraph & Telephone Public Corporation, Tokyo, Japan

[21] Appl. No.: 703,453

[22] Filed: Feb. 20, 1985

Related U.S. Application Data

[63] Continuation of Ser. No. 499,403, May 31, 1983, abandoned.

[30] Foreign Application Priority Data

May 31, 1982 [JP] Japan ..... 57-92634
Jun. 30, 1982 [JP] Japan ..... 57-111549
Sep. 6, 1982 [JP] Japan ..... 57-153861

[51] Int. Cl.[4] ..... G03C 5/54; G03C 1/733; B41L 1/20

[52] U.S. Cl. ..... 430/201; 346/201; 346/214; 430/964; 430/200

[58] Field of Search ..... 430/200, 201; 346/201, 346/214; 427/150

[56] References Cited

U.S. PATENT DOCUMENTS

| | | | |
|---|---|---|---|
| 3,476,578 | 11/1969 | Brinckman | 427/150 |
| 3,594,208 | 7/1971 | Wiese et al. | 427/150 |
| 3,965,282 | 6/1976 | Janssens et al. | 430/200 |
| 4,114,926 | 9/1978 | Habib et al. | 427/150 |
| 4,284,696 | 8/1981 | Ishida et al. | 430/42 |
| 4,311,750 | 1/1982 | Kubo et al. | 428/212 |

*Primary Examiner*—Richard L. Schilling
*Attorney, Agent, or Firm*—Cushman, Darby & Cushman

[57] ABSTRACT

Optical recording medium includes a substrate, a coloring agent layer formed on the substrate, a light absorber layer formed on the coloring agent layer and a developer layer formed on the light absorber layer. The coloring agent layer is separated from the developer layer by the light absorber layer and the lamination layer composed of these layers has a uniform thickness. The optical recording medium is produced by vacuum depositing a coloring agent, a light absorber and a developer successively on the substrate to form a multi-layer construction, the substrate being capable of transmitting visible light and near infrared light. Alternatively, the optical recording medium contains a plurality of lamination layers mentioned above. The optical recording medium has a high contrast and achieves a high speed multi-color recording.

5 Claims, 4 Drawing Figures

OPTICAL RECORDING MEDIA WITH THERMAL COLORATION AND PROCESS FOR PRODUCING SAME

This is a continuation of application Ser. No. 499,403, filed May 31, 1983, which was abandoned upon the filling hereof.

BACKGROUND OF THE INVENTION

1. Field of the Invention

The present invention relates to an optical recording media capable of thermal sensitive recording by the scanning lights from a recording light source and process for producing the same.

2. Prior art of the Invention

Thermal sensitive recording is a direct recording method requiring developing and fixing.

This conventional method have been used in a simple terminal device of printer and facsimile since it can be easily operated and does not required much maintenance. However, in such a termal sensitive recording method, a thermal head or a thermal pen directly contacts a surface of the recording medium. As a result, dregs of the recording material adhere to the head or the pen. This adversely affects resolution and sensitivity of the the recording medium.

To overcome this difficulty, there has been proposed another conventional recording method in which a xenon lamp as a light source is exposured to color a thermal sensitive recording medium. Usual optical, thermal sensitive recording medium is provided to form a coloring agent on a substrate.

A recording original copy for transcription is laid on the medium and flashed by light from the light source. Then, the flashing light is absorbed into black portions of the copy to produce heat, and produced heat heats the coloring agent layer to produce the coloration in the recording medium. However, in this recording medium in this method, a considerable heat diffusion occurs at the black portions of the copy so that the medium is subjected to fogging and clouding around the recording image thereon, thereby lowering resolving power and sensitivity.

Instead of placing the copy on the recording medium in above-mentioned method, there has been proposed a recording method in which a coloring matter capable of absorbing wave length light of exposed light is dispersed into a thermal sensitive coloring agent so that the recording is effected by converting ther light absorbed in the coloring matter to heat.

In this case, however, the coloring matter such as Methylene Blue and Rhodamine B absorbs a visible light and in colored before the recording in effected. Therefore, the recording medium have a inferior contrast between before and after the recording. Also, there has been proposed an optical recording medium which contains near infrared light absorbing coloring matter as a light absorber dispersed into a thermal sensitive coloring agent. In this case, the medium has a week absorption in visible light region, and therefore this medium improves a contrast in the recording medium. With this method, however, it is unavoidable to lower a resolution of the medium due to fogging and clouding, and an uniform color development can not be obtained since the coloring material can not be uniformly dispersed in the coloring agent.

Conventional thermal sensitive medium is prepared by dispersing ununiformly the coloring agent and the developer into a binder in the form of colloid or microcapsule. Since recording parts in the thermal sensitive medium become white and opaque, high energy of recording light source have larger loss due to the scattering of the light in the direction of the thickness of the coloring agent layer, and therefore the recording medium has a lowered resolution and an inferior sensitivity.

The prior art optical recording materials with thermal coloration and conventional multi-coloring material will be described, U.S. Pat. No. 4,284,696 (Ishida et al.) discloses a light transmission particle containing as a colorless sublimable dye, an acyl leucophenoxazine compound to form a color image. This particle can produce a clear color image having little fogging and having an excellent resolving power.

Also, U.S. Pat. No. 4,311,750 (Kubo et al.) discloses a multi-color thermo-sensitive recording material comprising two thermo-sensitive coloring layers capable of forming different color respectively at different temperature. A discoloring layer comprising a cross-linking type resin is disposed between the two thermo-sensitive coloring layers. This discoloring layer is cross linked in the course of the coating of the thermo-sensitive layers, so as to prevent either of the two thermo-sensitive coloring layers from being dissolved.

However, the above-mentioned patents fail to solve fundamental problems encountered in the use of thermo-sensitive coloring material for optical recording. It is preferred that the optical recording medium comprises laminated coloring agent layer, light absorber layer and developer layer each having a uniform thickness in a direction perpendicular to the surface of the recording medium, these layers being separated from one another in the direction of the thickness of in the medium. It is desirable that the layer have such a transparency that it is allows the recording light to reach the light absorber layer without any loss.

Based on these thoughts, there has been proposed an optical recording medium of a multi-layer construction which is prepared by dissolving homogeneously a coloring agent, a developer and a light absorber in a polymer to form solutions and then spin coating these homogeneous solutions successively on a substrate to form the multi-layer. However, this method is disadvantageous in that each of the already coated intermediate layers is liable to be affected during the spin coating.

Also, the coloring agent and developer are diluted by the polymer solution so that the concentration of each homogeneous solution becomes lower. In the case where the coloring agent and the developer are added to the polymer in larger amount to increase the concentrations, it is difficult to a homogeneous solution. The resulting layer becomes turbid. The problems described above for the dispersion binder type medium are also encountered in this method.

SUMMARY OF THE INVENTION

An object of the present invention is to provide an optical recording medium of a multi-layer construction which is capable of color-recording by exposing of wavelength light from a recording light source and has high resolving power and high sensitivity.

Another object of the present invention is to provide an optical recording medium of a multi-layer construction which can realize a high speed multi-color recording having a high contrast and can apply a disk medium capable of coloring multi-wave length light and a color-microfilm.

A further object of the present invention is to provide a process for producing the above-mentioned optical recording medium with thermal coloration.

According to the present invention, there is provided an optical recording medium with thermal coloration which comprises a substrate capable of transmitting visible and near infrared light and a multi-layer including a coloring agent layer of transparent leuco dye formed on the substrate, a light absorber layer formed on the coloring agent layer and capable of absorbing wavelength light from a recording light source, and a developer layer of transparent solid acid formed on the light absorber layer. The recording medium laminated multi-layers each includes the coloring agent layer, the light absorber layer and the developer layer.

Process for producing optical recording medium with thermal coloration comprises of the step of providing a substrate capable of transmitting visible and near infrared light in a vacuum chamber, depositing in vacuum a coloring agent of leuco dye on said substrate to form a transparent coloring agent layer, depositing in vacuum a light absorber capable of absorbing a recording light from recording light source on said color agent layer to form a light absorber layer, depositing in vacuum a developer on said light absorber layer to form a developer layer.

BRIEF DESCRIPTION OF THE DRAWINGS

The present invention will be illustrated in detail with reference to the accompanying drawing showing the preferred embodiments. However, the present invention is not intended to be limited by these drawing.

DETAILED DESCRIPTION OF THE INVENTION

Figure 1:
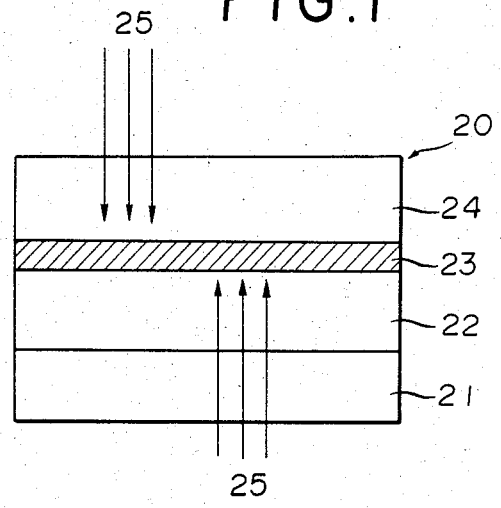
FIG. 1 is schematic drawing showing a section of a fundamental constitution of optical recording medium according to the present invention.

As shown in FIG. 1, recording medium 20 according to one embodiment of the present invention includes a substrate 21, a coloring agent layer or a developer layer 22, a light absorber layer 23 and a developer layer or a coloring agent layer 24. A light 25 is exposured on either a layer 24 side or a layer 22 side through a substrate 21. There can be prepared an optical recording medium capable of a monochromatic or multi-colored coloration so that the medium have at least more than a set of the fundamental constitution including the coloring agent layer, the light absorber layer and the developer layer on the transparent substrate. Substrate 21 is a material capable of transmitting to a visible light and a near infrared light. As the substrate the following can be employed; poly methylmethacrylate, polycarbonate, poly ethyleneterphthalate and glass.

Layer 22, 24 shows thin layer of either the coloring agent or the developer which is vacuum depositing on the substrate. It is important that the light absorber layer is interposed between the coloring agent layer and the developer layer.

As the coloring agent the following can be employed: Crystal Violet Lactone 3.3-bis (p-dimethylaminophenyl)-6-diethylaminophthalide), Benzoyl Leuco Methylene Blue as blue coloring agent, 3-chloro 6-cyclohexylamino fluorane, N-phenyl rhodamine lactam as red coloring agent, 2-methyl 3-phenylamino 8-diethyl amino fluoran as black coloring agent, Malachite Green Lactone (3,3-bis-(p-dimethylaminaphenyl phthalide), 3-diphenyl amino 8-diethyl amino fluoran, 3-chlorophenyl-methylamino 8-diethylamino fluoran as green coloring agent, React Yellow commercially available from BASF JAPAN CO. under trade name as yellow coloring agent.

As the developer agent the following can be employed: phenolphthalein, thymolphthalein, tetra bromophenol blue, thymol blue, pyrogallol red, pyrogallol violet, phenolsulfophthalein, aurin, eosin yellow, mixture of 2,2 bis (4'-hydroxyphenyl) propane and stearic acid amide, methylol amide and mixture of 1,3-diphenyl guanidine, imidazol and stearic acid amide, methylol amide.

As the light absorber capable of vacuum depositing the following can be employed: phthalocyanine blue, fluorescein Rhodamine 6G, C.I. Disperse Yellow 5 (commercially available from SUMITOMO KAGAKU Co. Ltd. under trade name of MIKARON YELLOW 5GE). As near infrared light absorber capable of vacuum depositing the following can be employed: diethylaminonaphthol squarrium, dimethylaminonaphthol squarrium diethylamino phenol squarrium and dimethylaminophenol squarrium.

As the infrared light absorber having metal phthalocyanine compound which does not require Cu phthalocyanine and capable of vacuum depositing the following can be employed: vanadium phthalocyanine, aluminium phthalocyanine. As the near infrared light absorber capable of vacuum depositing the following can be employed: bis-(cis-1,2 toluyl) ethylen1,2 dithiolate nickle and its platinum metal complex, bis-(cis-1,2 phenyl) ethylen-1,2 di-thiolate nickel, bis-(1 chloro 3,4 dithio phenol) nickel and bis-(4-dimethylamino 1,2-dithiophenolate) nickel.

Also, as the developer capable of vacuum depositing and absorbing argon laser having 480 nm wavelength the following can be employed aurin and fluorescein.

Also, as the developer capable of vacuum depositing and having a phenolic hydroxy group the following can be employed pyrogallol red, alizalin, morin, quercetin and cresol red.

When phenolphthalein is employed as phenolic developer, phenolphalin can be used with Crystal Violet Lactone and N-phenyl rhodamine Lactam as developer, used with diphenyl guanidine as coloring agent capable of red coloration.

Optical recording medium are produced by vacuum depositing successively on the substrate to form multi-layer construction including the coloring agent layer, the light absorber layer and the developer layer.

This process for producing can be controlled easily by vacuum depositing to form a depositing layer having uniform thickness, produced by switching depositing source in same vacuum chamber. Further, in this process for producing new depositing layer does not give any influence to underlayer deposited layer. Optical recording medium resulted by this process have a high contrast and a high effective concentration of material contained in each layer so as to it does not use in binder.

In process for producing, optical recording media are prepared by vacuum depositing under a range of from $1\times10^{-6}$ to $1\times10^{-5}$ Torr in vacuum chamber.

When the thickness of the coloring agent layer is less than 0.2 μm, it is difficult to obtain an effect of the coloring agent. When the thickness of the coloring agent layer is more than 20 μm, the obtained coloring agent layer has an unnecessary consumption of the material. Therefore it is determined that the thickness of coloring agent layer should be 0.2 to 20 μm, furthermore preferably 1 to 3 μm.

Thickness of light absorber is 100Å to 3000Å.

When thickness of the developer layer is less than 0.2 μm, it is difficult to obtain an effect as developer layer so as to lower coloring contrast of recording parts. When the thickness of the developer layer is more than 20 μm, the obtained developer layer has an unnecessary thickness of the medium. Therefore, it is determined that the thickness of developer layer should be 0.2 to 20 μm, furthermore preferably 1 to 3 μm.

Process for producing optical recording medium will be illustrated as follows. The raw materials including coloring agent, light absorber and developer placed on depositing boat are vacuum deposited successively on a substrate to form multi-layer construction.

A process for production comprises the step of providing a substrate capable of transmitting visible and near infrared light in vacuum chamber, depositing in vacuum the first coloring agent of leuco dye on the substrate to form first, transparent coloring agent layer, depositing in vacuum a first light absorber capable of absorbing first recording light from a recording light source on first coloring agent layer to form first light absorber layer, depositing in vacuum a first developer on first light absorber layer to form the first developer layer, furthermore, depositing in vacuum a second light absorber capable of absorbing a second recording light on the first developer layer to form the second light absorber layer, depositing in vacuum a second coloring agent of leuco dye on the second light absorber layer to form the second coloring agent layer.

Coloring agent layer and developer layer are transparent, uniform depositing layer. However, in vacuum deposition of some developers, it is difficult to obtain as transparent layer. In this case, it is effective to mix uniformly the developer with a sufficient amount of an aromatic amide and an aliphatic amide to form dispersion of solid solution. The obtained mixture capable of depositing can be employed as developer. The mixture of an aliphatic acid amide and solid acid absorber placed on depositing boat is vacuum deposited to form transparent developer layer which have an uniform surface and a good transparency to compare with the abovementioned opaque developer layer.

In the case of multi-coloration, the raw material including the coloring agent, the light absorber and the developer is vacuum depositing succesively on the substrate to form multi-layer construction capable of coloring in multi-color. The embodiments of the present invention will now be explained by referring to the following examples.

EXAMPLE 1

The thermal recording medium was prepared as follows. The following raw materials placed on tantalum boat were vacuum deposited successively under less more than $1\times10^{-5}$ Torr to form a multi-layer on a glass substrate.

| | thickness |
|---|---|
| (a) Phenolphthalein | 2.0 μm |
| (b) Crystal Violet Lactone | 2.0 μm |

The thermal recording medium has a transparency in visible to near infrared region and could be written by a thermal pen or thermal printing head to be colored in blue.

Coloring temperature of this medium was lower than that of a conventional thermal sensitive printing paper. The medium could colored in blue when subjected the ultraviolet recording light, which is useful.

EXAMPLE 2

The following raw materials placed on tantalum boat were vacuum deposited successively under $1\times10^{-5}$ Torr to form a multi-layer construction on poly methyl methacrylate plate. The medium of multi-layer constraction comprised a coloring agent layer (a), a light absorber layer (b) and a developer layer (c).

| | thickness |
|---|---|
| (a) N—phenyl Rhodamine Lactam, (commercially available from HODOGAYA KAGAKU Co., Ltd. under trade name of RED-DCF) | 2.0 μm |
| (b) bis (cis 1,2 toluyl) ethylen 1,2 dithiolate nickel (commercially available from NIPPON KANKO SHIKISO Co., Ltd. under trade name of NKX-113) | 2000Å |
| (c) Phonolphthalein | 2.0 μm |

The medium could colored in red when subjected to the diode laser recording light having 813 nm wavelength at 16 μmϕ of spot diameter for 40 nsec of puls light. The medium had about 30 mF/cm$^2$ of the recording sensitivity.

EXAMPLE 3

The following raw materials placed in molybdenum boat were vacuum deposited successively under $1\times10^{-5}$ Torr to form a multi-layer on a polyethylene terephthalate. The medium of multilayer construction comprised a coloring agent layer (a), a light absorber layer (b), a developer layer (c), a light absorber layer (d) and a coloring agent layer (e). The construction of this optical recording medium was shown in FIG. 2. That is a section of the medium according to the present invention. Layers 41–45 were laminated on the substrate 46 successively as showing FIG. 2.

Figure 2:
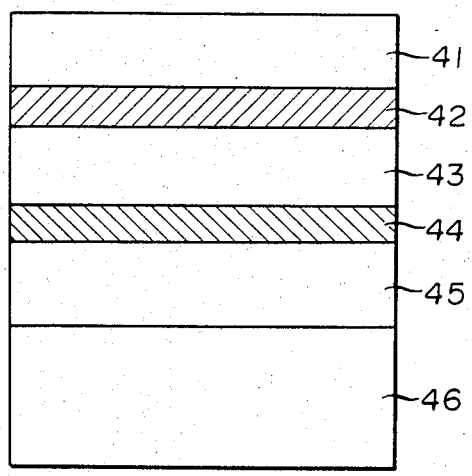
FIG. 2 is schematic drawing showing a section of optical recording medium.

| | thickness | number in FIG. 2 |
|---|---|---|
| (a) Crystal Violet Lactone | 3.0 μm | 41 |
| (b) bis (1-chloro 3,4-dithiolate phenolate) nickel (commercially available from MITSUI TOATSU FINE Co., Ltd. under trade name of PA-1006 λmax: 8.70 nm) | 3000Å | 42 |
| (c) phenolphthalein | 40 μm | 43 |
| (d) light absorber (commercially available from MITSUI TOATSU FINE | 3000Å | 44 |

-continued

| | thickness | number in FIG. 2 |
|---|---|---|
| Co., Ltd. λmax: 1100 nm) | | |
| (e) N—phenyl rhodamine lactam (commercially available from HODOGAYA KAGAKU Co., Ltd. under trade name of RED-DCF) | 3.0 μm | 45 |

The medium could colored in blue when subjected to the diode laser recording light having 850 nm wavelength and then a layer 42 was melted, as a result, then a layer 41 reacted with a layer 43.

The medium could colored in red when subjected to the diode laser recording light having 1100 nm wavelength and then a layer 44 absorbed the light which converted a heat, as a result, the layer 44 was melted, then the layer 43 reacted with the layer 45. The optical recording medium had about 30 mJ/cm$^2$ of recording sensitivity.

EXAMPLE 4

The following raw materials placed on tungsten boat were vacuum deposited successively under $1\times10^{-5}$ Torr to form a multi-layer on the polyethylene terephthalate.

| | thickness |
|---|---|
| (a) 2-methyl 3-phenylamino 8-diethylamino fluorane (commercially available from HODOGAYA KAGAKU Co., Ltd. under trade name of TH-107) | 2.0 μm |
| (b) Aurin | 2.0 μm |

Figure 3:
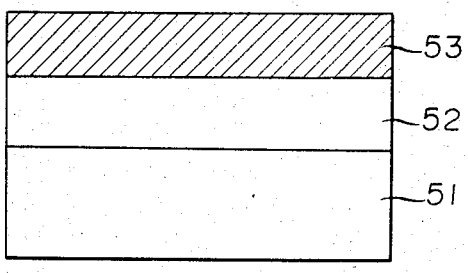
FIG. 3 is schematic drawing showing a section of another optical recording medium.

This resulted medium was shown a section in FIG. 3 according to an embodiment of the present invention. Aurin layer 53 was laminated on the coloring agent layer 52 and a coloring agent layer 52 was laminated on the substrate 51. The resulted medium could colored in orange when subjected to recording light having 480 nm wavelength. Also the result medium could colored in black when subjected to argon laser recording light having 488 nm wavelength. The medium had about 20 mJ/cm$^2$ of recording sensitivity.

EXAMPLE 5

The following raw materials were vacuum deposited successively on a paper to form optical recording medium of multi-layer.

| | thickness |
|---|---|
| (a) 1,3 diphenyl guanidine | 3.0 μm |
| (b) fluorescein | 3000Å |
| (c) thymolphthalein | 2.5 μm |

1,3 diphenyl guanidine was deposited in vacuum on the paper to form crystalline layer since it did not contaminate white surface of the paper. Fluorecein was deposited in vacuum to form yellowish layer having λmax 480 nm and thymolphthalein deposited in vacuum on 1,3 diphenyl guanidine layer to form a transparent layer.

The medium could the colored in blue when subjected to argon laser recording light having 488 nm wavelength and then thymol phthalein was reacted with 1,3 diphenyl guanidine. The medium had about 50 mJ/cm$^2$ of recording sensitivity. An above-mentioned medium which did not employ fluorescein could be colored in blue when heated by the thermal head.

EXAMPLE 6

The following raw materials were vacuum deposited successively on methyl methacrylate plate to form optical recording medium of multi-layer.

| | thickness |
|---|---|
| (a) 1,3 diphenyl guanidine/ stearic acid amide mixture (1:1 by weight) | 4.0 μm |
| (b) bis (cis 1,2 toluyl) ethylene 3.2 dithiolate nickel (commercially available of NIPPON KANKO SHIKISO Co., Ltd. under trade name of NKX-113 λmax: 350 nm) | 3000Å |
| (c) phenolphthalein | 3.0 μm |
| (d) vanadium phthalocyanin | 3000Å |
| (e) Crystal Violet Lactone | 2.0 μm |

The mixture of 1,3 diphenyl guanidine and stearic acid amide was deposited in vacuum to form a transparent, excellent layer. The resulted medium could colored in blue when subjected to diode laser recording light having 780 nm wavelength and then Crystal Violet Lactone reacted with phenolphthalein. Also, the medium could colored in rose when subjected to diode laser recording light having 840 nm wavelength and then phenolphthalein reacted with 1,3 diphenylguanidine. The medium had about 50 mJ/cm$^2$ of recording sensitivety.

EXAMPLE 7

The following raw materials placed on tantalum boat were vacuum deposited successively under less more than $1\times10^{-5}$ Torr on a glass plate to form multi-layer.

| | thickness |
|---|---|
| (a) Crystal Violet Lactone | 5.0 μm |
| (b) fluorescein | 3000Å |
| (c) mixture of 2,2-bis (4-oxyphenyl) propane and stearic acid amide (1:1 by weight) | 5.0 μm |

Figure 4:
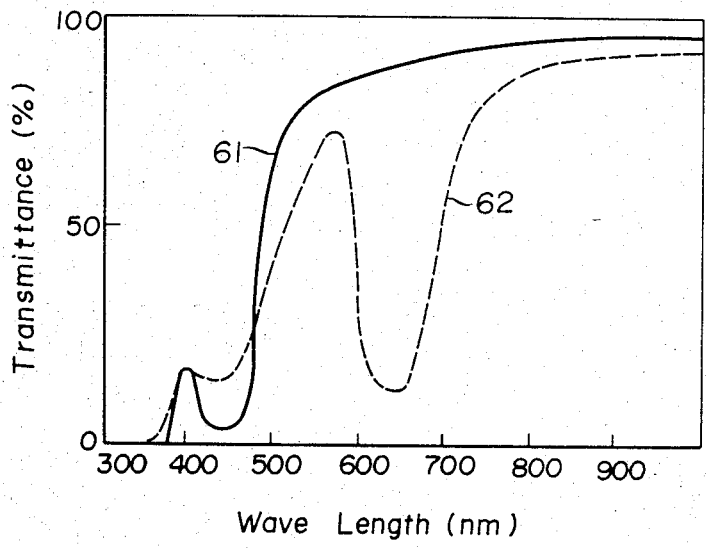
FIG. 4 is a graph showing a transmittance characteristics of optical recording medium.

Absorption characteristics of resulted optical recording medium showed in FIG. 4. Curve 61 showed transmittance of the medium before exposure, curve 62 showed transmittance of the medium after exposure in which absorption of 450 nm wavelength based on absorption of fluorescein. The medium could colored in blue as showing doted line of FIG. 4 when subjected to argon laser having 488 nm wavelength with 10 mW of output at 10 μmϕ of spot diameter for 100 nsec. The medium had a resolution of 5 μm line and space when subjected to laser light through mask of metal pattern.

EXAMPLE 8

The following raw materials placed on tantalum boat were vacuum deposited successively on methyl methacrylate plate to form multi-layer construction similar to Example 7. Polyethylene terephthalate film was subjected to contact bonding on the multi-layer construction to form recording medium.

| | thickness |
|---|---|
| (a) N—phenyl rhodamine lactam (commercially available from HODOGAYA KAGAKU Co., Ltd. under trade name of RED-DCF) | 5.0 μm |
| (b) aluminium phthalocyane | 2000Å |
| (c) mixture of methylol amide and 4 hydroxyphenoxide (1:2 by weight) | 4.0 μm |

The medium could colored in red when subjected to diode laser light having 830 nm wavelength with 6 mW of laser output at 1.6 μmϕ of spot diameter for 30 nsec of pulse light. The medium had about 20 mJ/cm$^2$ of recording sensitivity.

EXAMPLE 9

The following raw materials placed on molybdenum boat were vacuum deposited successively on polyethylen terephthatlate film to form multi-layer construction.

| | thickness |
|---|---|
| (a) Crystal Violet Lactone | 3.0 μm |
| (b) bis-(1-chloro-3,4-dithiophenolate) nickel (commercially available from MITSUI TOATSU FINE Co., Ltd. under trade name of PA-1006 λmax: 870 nm) | 3000Å |
| (c) mixture of 2,2-bis (4'-oxyphenyl) propane and stearic acid amide (1:1 by weight) | 5.0 μm |
| (d) light absorber (commercially available from MITSUI TOATSU FINE Co., Ltd. under trade name of PA-1002 λmax: 1100 nm) | 3000Å |
| (e) N—phenylrhodamine lactam (Commerciall available from HODOGAYA KAGAKU Co., Ltd. under trade name of RED-DCF) | 3.0 μm |

The medium could colored in blue when subjected to diode laser light having 850 nm wavelength. Also the medium could colored in red when subjected to diode laser light having 1100 nm wavelength. This medium could be recorded by writing of above-mentioned different lights two coloration of the recording. The medium had about 20 mJ/cm$^2$ of recording sensitivity.

EXAMPLE 10

The following raw materials placed on tungusten boat were vacuum deposited successively on polyethylen terephthalate film to form multi-layer of optical recordin medium.

| | thickness |
|---|---|
| (a) 2-methyl 3-phenylamino 8-diethylamino fluoran (commercially available from HODOGAYA KAGAKU Co., Ltd. under trade name of TH-107) | 5.0 μm |
| (b) mixture of 2,2-bis (4'-oxyphenyl) propane and stearic acid amide (2:1 by weight) | 2.0 μm |

When this optical recording medium was heated to contact by usual thermal sensitive head, it could be confirmed that the medium had recording contrast equally or over more than to compared with commercially available thermal sensitive paper.

EXAMPLE 11

The following raw materials placed on tantalum were vacuum deposited successively on polymethyl methacrylate plate to form multi-layer of optical recording medium.

| | thickenss |
|---|---|
| (a) 3 di-phenylmethyl amino 8 diethyl fluoran | 1.5 μm |
| (b) di-methylaminonaphthol squarrium (λmax: 780 nm) | 5000Å |
| (c) thymol phthalein | 2.0 μm |

The medium could colored in green when subjected to diode laser light having 780 nm wavelength. The medium had about 40 mJ/cm$^2$ of recording sensitivity.

What we claim is:

1. An optical recording medium with thermal coloration capable of monochromatic or multi-colored coloration which optical recording medium comprises:

a substrate capable of transmitting visible and near infrared light, a first coloring agent layer consisting of a transparent leuco-dye, said first coloring agent layer formed by vacuum deposition on said substrate, wherein said lueco-dye is selected from the group consisting of 3,3-bis (p-dimethylamino phenyl)-6-dimethylaminophthalide, 3,3-bis (p-dimethylamino phenyl) phthalide, 3-chloro-6-cyclohexylamino fluoran, 3-diphenylamino 8-diethylamino fluoran, 3-chlorophenyl-methlyamino 8-diethylamino fluoran, and 3-methyl 3-phenylamino 8-diethylamino fluoran, a first light absorber layer formed by vacuum depostion on said first coloring agent layer and capable of absorbing a first wavelength light from a recording light source, wherein said first light absorber layer consists of a compound selected from the group consisting of copper phthalocyanine, fluorescein, vanadyl phthalocyanine, aluminum phthalocyanine, bis-(cis-1,2 toluyl) ethylene 1,2 dithiolate nickel, bis-(1-chloro 3,4-dithiophenolate) nickel, bis-(4-dimethylamino 1,2 dithiophenolate) nickel, N-dimethylaminonaphthal squarrium, and N-diethylamino-naphthol squarrium, and a first developer layer consisting of a transparent solid acid, said first developer layer formed by vacuum deposition on said first light absorber layer, whereby said first light absorber layer is interposed between said first coloring agent layer and said first developer layer, wherein said solid acid is selected from the group consisting of phenolphthalein, thymolphthalein, alizarin, morin, quercetin, 2,2 bis (4-hydroxyphenyl) propane, a mixture of 2,2 bis (4-hydroxyphenyl) propane and stearic acid amide having the ratio of 1:1 by weight, a 4 hydroxy phenoxide and a mixture of 4-hydroxy phenoxide and methylol amide having the ratio of 1:2 by weight.

2. An optical recording medium as claimed in claim 1 wherein said substrate is a substrate selected from the group consisting of a polymethylmethacrylate plate, a polyethylene terephthalate film, a glass plate, and a polycarbonate plate.

3. An optical recording medium as claimed in claim 1 which further comprises a second light absorber layer capable of absorbing a second wavelength of light from a second recording light source formed on said first developer layer and a second coloring agent layer of transparent leuco-dye formed on said second light absorber layer.

4. An optical recording medium with thermal coloration capable of monochromatic or multi-colored coloration which optical recording medium comprises:

a substrate capable of transmitting visible and near infrared light, a first developer layer consisting of a transparent solid acid, said first developer layer formed by vacuum deposition on said substrate, wherein said solid acid is selected from the group consisting of phenolphthalein, thymolphthalein, alizarin, morin, quercetin, 2,2 bis (4-hydroxphenyl) propane, a mixture of 2,2 bis (4-hydroxyphenyl) propane and stearic acid amide having the ratio of 1:1 by weight, 4-hydroxy phenoxide, and a mixture of 4-hydroxy phenoxide and methylol amide having the ratio of 1:2 by weight, a first light absorber layer formed by vacuum deposition on said first developer layer and capable of absorbing a first wavelength light from a recording light source, wherein said absorber layer consists of a compound selected from the group consisting of copper phthalocyanine, fluorescein, vanadyl phthalocyanine, aluminum phthalocyanine, bis-(cis-1,2-toluyl) ethylene 1,2 dithiolate nickel, bis-(1-chloro 3,4-dithiophenolate) nickel, bis-(4-dimethylamino 1,2 dithiophenolate) nickel, N-dimethylamino-naphthol squarrium, and N-diemthylaminonaphthol squarrium, and a first coloring agent layer consisting of a transparent leuco-dye, said first coloring agent layer formed by vacuum deposition on said first light absorber layer, whereby said first light absorber layer is interposed between said first developer layer and said first coloring agent layer, wherein said leuco-dye is selected from the group consisting of 3,3-bis (p-dimethylamino phenyl)-6-dimethylaminophthalide, 3,3-bis (p-dimethylamino phenyl) phthalide, 3-chloro-6 cyclohexylamino fluoran, 3-diphenylamino 8-diethylamino fluoran, 3-chloro-phenylmethylamino 8-diethylamino fluoran, and 2-methyl 3-phenylamino 8-diethylamino fluoran.

5. An optical recording medium according to claim 4 wherein said substrate is a substrate selected from the group consisting of: (i) a polymethylmethacrylate plate, (ii) a polyethylene terephthalate film, (iii) a glass plate and (iv) a polycarbonate plate.

* * * * *